United States Patent [19]

Lahr

[11] Patent Number: 4,828,413

[45] Date of Patent: May 9, 1989

[54] ROTARY PRINT ELEMENT, COMPONENTS THEREOF AND DRIVE COUPLING APPARATUS THEREFOR

[75] Inventor: Roy J. Lahr, Los Angeles, Calif.

[73] Assignee: Creative Associates, Los Angeles, Calif.

[21] Appl. No.: 884,873

[22] Filed: Jul. 9, 1986

Related U.S. Application Data

[63] Continuation of Ser. No. 777,564, Sep. 18, 1985, abandoned, which is a continuation of Ser. No. 570,733, Jan. 16, 1984, abandoned.

[51] Int. Cl.[4] ..... B41J 1/30

[52] U.S. Cl. ..... 400/174; 400/144.2; 400/175

[58] Field of Search ..... 400/144, 144.1, 144.2, 400/144.3, 174, 175, 456, 457, 458, 459, 460, 460.1, 460.2, 461, 462, 463; 101/93.18, 93.19; 84/94 R, 95 R, 408; 188/378, 379; 248/559; 267/136, 137; 279/1 B, 1 E, 1 L, 1 M, 1 S, 35, 37, 106, 108

[56] References Cited

U.S. PATENT DOCUMENTS

| | | | |
|---|---|---|---|
| 3,707,214 | 12/1972 | Ponzano | 400/174 |
| 3,935,937 | 2/1976 | Tramposch | 400/174 |
| 4,124,930 | 11/1978 | Bauer | 400/174 |
| 4,235,664 | 11/1980 | Menke | 400/174 |
| 4,251,318 | 2/1981 | Oberg et al. | 400/174 |

*Primary Examiner*—David A. Wiecking
*Attorney, Agent, or Firm*—Kenyon & Kenyon

[57] ABSTRACT

Improved rotary-type printing wheels, components thereof and mechanisms for mounting the printing wheels to a drive are disclosed. The disclosed printing wheels have a reduced rotary moment of inertia. As compared to all plastic printing wheels, they have improved print characteristics and service life while still having a reduced rotary moment of inertia. The printing wheels include a central hub having teeth extending along its periphery which are engaged by a drive. Alignment apparatus is provided for aligning the hub and drive, but rotary torque need only be applied to the printing wheel hub through the peripherally disposed teeth. The spoke elements of the printing wheel are made of metal and can be formed as one piece with the hub or separately. The tips of the spoke elements have a configuration which facilitates and improves attachment of a character element thereto while reducing the rotary moment of inertia of the print wheel. The tips also have an integrally formed surface which mates with and is guided by a correspondingly shaped surface of an impact hammer. A die system is disclosed for forming spoke tips in which removable die inserts are provided so that any spoke tip can have any of several widths. This enables special order print wheels having either proportional or standard spacing to be fabricated relatively quickly and inexpensively. Damping structures are disclosed for restaining unwanted motion of a spoke along the path followed by the spoke during printing and restraining structures are disclosed for resisting torsional motion of the spoke bars. The damping and restraining structures also contribute to reducing the overall rotary moment of inertia of the print wheel.

17 Claims, 9 Drawing Sheets

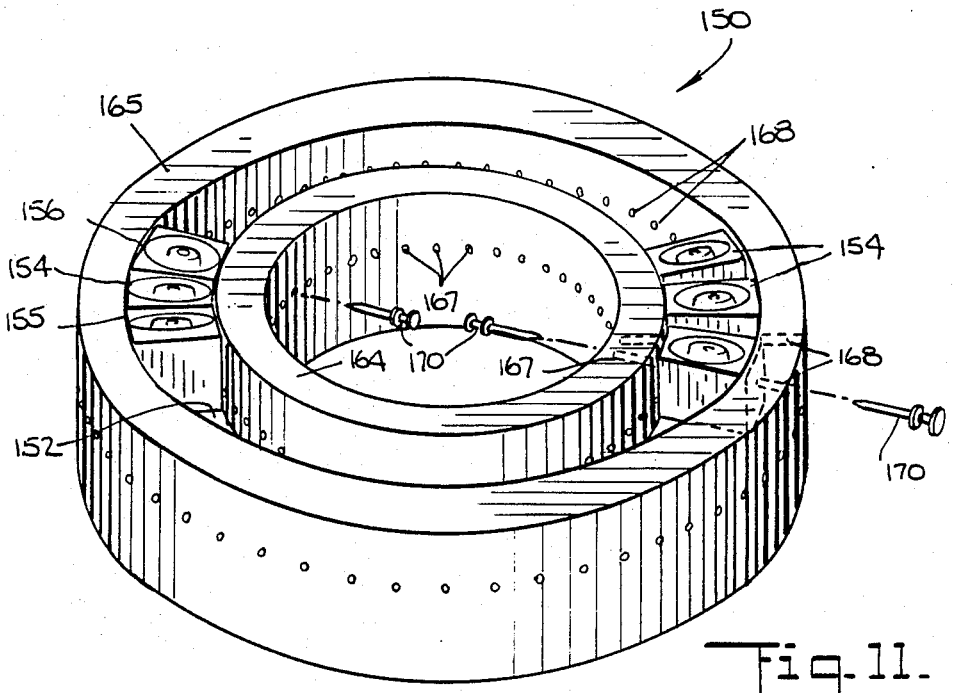
Fig. 11.
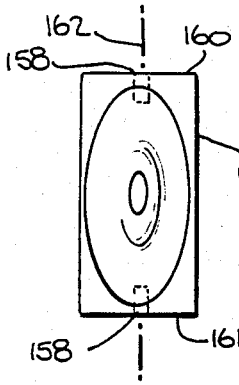
Fig. 12.
Fig. 13.
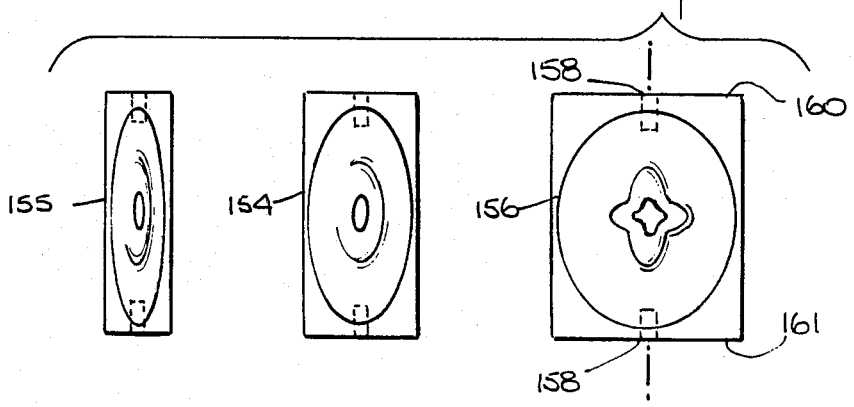

ROTARY PRINT ELEMENT, COMPONENTS THEREOF AND DRIVE COUPLING APPARATUS THEREFOR

This application is a continuation, of application Ser. No. 777,564, filed Sept. 18, 1985, now abandoned, which is a continuation of Ser. No. 570,733 filed Jan. 16, 1984, now abandoned.

BACKGROUND OF THE INVENTION

The invention disclosed herein relates generally to serial impact printers which utilize a multi-character printing element mounted on a translatable print carriage, and more particularly to an interchangeable rotary print element and drive coupling apparatus therefor, and components thereof such as a print wheel hub, radial elements, motion restraining structures, and to the formation of such a rotary print element and components thereof.

Business today is increasingly relying on electronic information handling systems. Typically, serial impact printers are used as part of such systems to obtain hard copy. Since serial impact printers print at speeds significantly below the information flow rate available from most modern business information systems, the wait for hard copy usually constitutes a significant, if not the single most significant, factor in obtaining hard copy output from such systems. This is particularly true for modern information handling systems such as word processors, which typically utilize a visual image on a display unit for editing or changing a document. It is therefore not difficult to rapidly edit a very long document, particularly if only a few pages are to be changed. Once the desired changes have been made using the display unit, and the document reformatted if necessary, there is a need to quickly obtain hard copy of the revised document.

There is an accompanying need in business offices for local production of documents with particularly high print quality, such that when optically copied, as is now common in business office practice, the output copies present a highly readable and attractive appearance after any image degradation in the copying process.

There is thus the need to provide high quality hard copy at increased printing speeds.

The faster type of correspondence-quality printers which are commercially available are generally of the impact type, and use a rotating print element having radial elements (commonly referred to as "spokes" or "spoke") extending therefrom each of which carries at least one fully-formed character face. As used herein, the term radial element and spoke or spoke element are used essentially interchangeably and in an unlimiting sense to refer to an element which may be of almost any shape extending from a central element such as a hub or ring. As used herein, the term "character" includes letters, numbers, mathematical and other symbols, etc., and is not used in a limiting sense The rotatable print element is conveyed on a carriage which delivers the print element to each location where a character is to be printed. The print element is in turn rotated to bring the selected spoke with its character face into a printing position. Thus, the print element experiences at least two types of motion, rotating motion for bringing a selected character into a print position with respect to the carriage, and generally lateral motion for positioning the carriage at the appropriate location where the character is to be printed. If the productive output, as measured by printing speed, is to be increased, then the rate at which either and preferably both such motions are performed must be increased.

In most commercially available printing arrangements for serial impact printers utilizing a rotary print element, a motor and means coupling the motor to the print element provide for rotation of the print element to position the desired character for printing. Inasmuch as the rotary element need only traverse a fraction of a revolution in either direction to bring the desired character into position, the major performance criterion is that of rotary acceleration and deceleration times encountered in traversing the required angular distance between initial and final positions. Since a driving motor for the print element must accelerate its own internal rotor and the rotation coupling means, considerable effort has been expended in attempts to keep motor and coupling means rotary moment of inertia to a minimum. Moreover, since the motor must also accelerate and decelerate the rotary print element, efforts have also been expended to reduce the rotary moment of inertia of the rotary print element itself.

Heretofore rotary print elements having the capability of high print quality also had an overly-large rotary moment of inertia, which restricted the accelerational motions available from a given size motor and coupling means combination. On the other hand, with lighter weight print elements, print quality was not entirely satisfactory. Earlier commercial rotary print elements were formed by casting the print element in one piece using durable, lightweight plastic. In order to improve the print quality of such print elements, many character elements, particularly those intended for printing on one or two ply paper, were made with a minimal surface relief from an unreinforced phenolic thermosetting resin. Such resins are known to have good impact strength and a printing life of many millions of impacts. Some of the all-plastic print elements were made of an injection molded thermoplastic, such as a type 66 Nylon available from A. L. Hyde Company, Grenloch, New Jersey, to which phonolic resin character elements were affixed. It was known to metal plate molded R phenolic resin character faces, but essentially for cosmetic reasons to give the molded character faces a pleasing metallic appearance. Later commercial units for very high quality work utilized a plastic hub into which were cast metal spokes with metal-plated plastic character tips affixed to the ends of the spokes.

For slower speed print elements which can tolerate a higher rotary moment of inertia, the character face can be of metal rather than plastic, formed by press swagging, electroforming, or other methods. However, such metal character face print elements were as a general matter used for specialized printing, for example, where thick, multicopy sets are printed, as in transport waybills, or where long periods of printing on abrasive surfaces are required, as in direct production of dual text containing visible text and braille embossing.

Spoke tips comprised of a character element or face and a rear pad, simultaneously cast together from two mating halves of a plastic molding die are also known. The rear pad may also bear a raised or indented portion which engages a mating surface on the nose area of an impact element or hammer, which acts to stablize the hammer impact, and in some cases to align the character pad centerline along the fixed hammer path. The rear strike pad also, in a limited manner, distributes the impact over the character face. This pair of plastic elements, a rear pad and a front face, were usually cast simultaneously in a mating mold set. One mold half was used to cast all pads, and the other mating mold half was used to cast all of the character faces, the two halves of the mold thereby integrally shaping the spoke tip as a unit. After forming, the character faces were then metallicly plated. While the metallic plating improved print quality and increased the life of the print element, the presence of a large, plated plastic mass at the outer tips of the spokes constituted a major component in the overall rotary moment of inertia of the print element.

There is thus a need to provide an improved spoke tip for a rotary print element which is easy to manufacture, and/or which provides good print quality, and/or which does not add to, and preferably reduces, the rotary moment of inertia of the print element and/or which has good service life.

Despite the improved quality, the metal-plastic print element had an increased rotary moment of inertia that tended to slow down the printer. For example, when an all plastic print element was used in a very high speed serial printer, the observed speed of the printer had burst speeds of 80 characters per second, but when a standard metal-plastic composite print element was used so as to achieve better print quality, the observed burst speed was reduced to 63 characters per second because of the higher rotary moment of inertia of the composite print element. Although it may have been possible to increase the burst speed of this particular printer with the composite print element by increasing motor accelerational capability, to do so necessitated the use of a much heavier motor which would, in turn, significantly encumber the translational speeds available. Increasing the size of the translational motor could compensate for the reduction in translational speed. However, for the particular printer, the translational linkages and guideways would have to be increased accordingly. Thus, simply increasing motor size to increase printing speed was not a satisfactory solution.

There is thus a need to provide print elements capable of high rotary and translational motions while producing high quality print, and to accomplish this without simply increasing motor size and linkage mass.

In order to make characters of differing languages or fonts available to the printing equipment operator, it is desirable to allow interchange of rotary print elements. Commercially available rotary print elements of which the most commonly used is known as a print wheel, are generally interchangeable if they have the same base configurations, i.e. the same hub configuration and the same angular subtent between spokes. Another requirement for interchangeability is that interchangeable print wheels, whether of the fixed or proportional spacing type, emplace the characters at identical vertical center lines. For manual interchange systems, it is also highly desirable that the steps needed for an interchange be relatively few and straightforward. Further, since most printing systems use a known reference line and some type of relative shaft angle encoder to deliniate the available character positions, each print wheel must only be emplaced with this same reference line. Interchangeable print wheels must also have compatible character position identifications and compatible hammer blow intensities for respective character positions, and that information regarding such operating characteristics be affixed to the print wheel so as to be manually identifiable by the operator. Such character set information and reference line validity enable a shaft encoder to deliver correct information as to spoke position to allow printing of desired characters.

Some known print wheels are permanently incorporated in a thin box, referred to as a containment box, that is itself inserted into the printer. This box allows the print wheel to be rotated by the system to find and lock-in the correct centerline. While the use of the print wheel box eliminates from the print wheel some of the rigors of manual handling, it does so at the cost of yet more translatable mass. In addition, known locking means may require substantial hub material at the inner radius, or root of the spokes, so as to transfer the high accelerational forces to the spokes which carry the character tips.

There is thus a further need to provide interchangeable print elements which are easy to change and yet are capable of quality, high-speed printing.

A composite print wheel, while delivering excellent print quality, has been so expensive as to restrict the range and type of print wheel use, thereby reducing full utilization of all the capabilities inherent in the rotary print wheel type of fast serial printer. The unitary, cast all-plastic print wheel has the virtue of simplicity in manufacture and thus can be provided at low cost, thereby encouraging the acquisition of a library of print wheels having different fonts and perhaps different language capability. In contrast, the composite metal-plastic print wheel requires over a dozen fabrication steps, many of high precision, so that the manufacturing cost of a high quality composite print wheel is an order of magnitude higher than the all-plastic print wheel. Also, because of the manufacturing complexity and cost, it is a known problem with the composite print wheel that the margin between manufacturing cost and sales price is much less than usual, so that supplies vendors usually only stocked the faster-moving, standard print wheels. On the other hand, supplies vendors who could provide other than standard print wheels charged more for the slower-moving special types, so that many users were unlikely to acquire a particularly extensive library of special print wheels. Thus, unless an urgent need for a special print wheel had been clearly demonstrated, it was unlikely that anything but a standard type print wheel could be obtained from stock. The tendency of the user has therefore been to ignore or forget the possibilities of performing variable font printing that could enhance the visual appearance of the output copy, and to be inclined to forget that the printer may have been capable of doing certain specialized tasks, such as mathematical symbol printing.

There has also been the need heretofore to customize a print wheel with a very special character set, perhaps having an unusual symbol, such as a firm's logo or an infrequently used mathematical symbol. When the total production run of such a special print wheel was small, it was uneconomical to make a special mold of the entire character set. As indicated above, existing composite print wheels have tip units which consist of two parts simultaneously cast to form one unit, a rear pad and a front strike face on which the raised character is placed. It is known to mold single characters in special mold units. These special mold units usually have a central cavity in the form of a slot which matches the dimensions of the spoke tip and are usually made to fit a spoke that already bears a little used special character, for example, the ampersand sign "&", which often appears as the upper case of the figure "7". The previously cast ampersand may be removed, after which a special character may be adhesively fixed. To aid such adhesive fixing of special characters, it was known to provide the spoke tip with a central hole to contain a glue droplet for best retention of the special character unit. (It was also known to use such holes in group casting to help affix the character element to the tip by a measure of through hole plastic casting.) A glue, such as a cyanoacrylate, can give good immediate retention, but the longer term glue bond properties occasionally lead to retention failures under heavy hammer impact blows. It is well known, however, that these special character emplacement methods cannot be used for a single-pass, all plastic casting in which all character elements are simultaneously formed.

There is thus a further need to provide special character set print wheels economically, preferably with good print quality and capable of high speed printing.

SUMMARY OF THE INVENTION

It is an object of the invention disclosed herein to fill the needs and solve the problems described above.

It is an object of the invention disclosed herein to increase the speed at which a rotary print element can print.

It is an object of the invention disclosed herein to provide a rotary print element capable of printing at higher speeds.

It is an object of the invention disclosed herein to provide a rotary print element having a lower rotary moment of inertia.

It is another object of the invention disclosed herein to provide a rotary print element having improved print quality.

It is another object of the invention disclosed herein to provide a rotary print element having improved stability.

It is another object of the invention disclosed herein to provide an improved tip for radial elements of a rotary print element.

It is another object of the invention disclosed herein to provide a rotary print element having one or more specialized characters or symbols which is simple to manufacture.

It is another object of the invention disclosed herein to provide a method for forming such tips which is simple and economical, and particularly suited to forming special character tips.

It is another object of the invention disclosed herein to provide improved methods for forming rotary print elements and components thereof.

It is another object of the invention disclosed herein to provide improved coupling means for coupling driving means to a rotary print element.

It is another object of the invention disclosed herein to facilitate removal and/or placement of a rotary print element on a printing apparatus.

It is another object of the invention disclosed herein to improve the placement accuracy of a rotary print element on a printing apparatus.

It is another object of the invention disclosed herein to provide an improved damping structure for a rotary print element for lowering the amplitude of unwanted spoke vibrations and which does not add materially and preferably reduces to the rotary moment of inertia of the print element.

It is another object of the invention disclosed herein to provide a print element hub having an improved hub reference line and locking system, so as to increase the accuracy of printing at faster speeds.

I is another object of the invention disclosed herein to provide a print element hub having an enhanced capability to transmit accelerational or decelerational torque to radial elements of the print element yet with less hub mass than presently utilized.

It is another object of the invention disclosed herein to provide a rotary print element capable of low cost manufacture without sacrificing print quality or performance over commercially known designs.

It is another object of the invention disclosed herein to provide a character and radial element tip assembly which permits special character emplacement without total dependence on glue affixation for positional retention.

It is another object of the invention disclosed herein to provide a rotary print element which achieves one or more of the above objects without increasing the rotary moment of inertia of the element.

It is another object of the invention disclosed herein to provide a rotary print element achieving one or more of the above objects which is economical to manufacture.

It is another object of the invention disclosed herein to provide a rotary print element achieving one more of the above objects capable of standard or proportionally-spaced printing.

The above and other objects are achieved by the invention disclosed herein.

In accordance with one aspect of the invention, a hub is provided for a rotary print element having a base portion and a peripheral portion, one of which is engaged by a drive means to rotate the hub and thereby the print element. Disposed in either or both the peripheral or base portion of the hub are a plurality of shaped surfaces by means of which torque is applied to the hub. Preferably, the shaped surfaces are disposed in the peripheral portion. Although the hub can include axial alignment means located centrally of the peripheral portion, torque is preferably transmitted to the hub essentially solely by means of the shaped surfaces. Thus, the alignment means need only perform an alignment function and do not have to be constructed so as to either transmit torque or withstand particularly high rotary forces generated during rotation of the print element.

According to an embodiment of the invention, the hub includes a base portion and a peripheral portion extending transversely from the base portion, the hub including a plurality of shaped surfaces disposed in the peripheral portion which are engagable by a plurality of correspondingly shaped surfaces on a drive means for transmitting a rotary force to the hub for rotating it, the shaped surfaces constituting essentially the sole means by which rotary driving force is applied to the hub. In accordance with an aspect of the invention, the shaped surfaces define rises and depressions adapted to be engaged by correspondingly shaped depressions and rises of the drive means. Preferably, the shaped surfaces protrude from the peripheral portion in the form of spaced teeth which are engagable by correspondingly shaped teeth of the drive means. Preferably the teeth are of generally triangular cross-section.

The base portion of the hub generally extends in a plane which is generally normal to the axis of rotation of the print element, and the peripheral portion extends from the base portion at an angle of from about 90° to about 165°. The shaped surfaces when disposed in the peripheral portion are consequently transversely disposed relative to the base portion.

In accordance with an aspect of the invention, the shaped surfaces on the hub of the print element do not become disengaged with the correspondingly shaped surfaces of the drive means once the hub has been properly seated on the drive means. Thus, the shaped surfaces of the hub and drive means do not become disengaged during a printing cycle, but only when it is desired to remove the print element from the drive means. This substantially eliminates or at least reduces wear of the shaped surfaces of both the hub and the drive means.

It is preferred that the shaped surfaces be distributed uniformly about the peripheral (or base) portion. However, since the shaped surfaces do not provide any alignment function, they may be disposed as desired about the peripheral (or base) portion. For example, they may be disposed in sets which are uniformly disposed about the peripheral portion. Alternatively, they may be disposed in sets which are non-uniformaly disposed about the peripheral portion. When the shaped surfaces are distributed nonuniformly, the spacing between any adjacent pair of shaped surfaces may be different from the spacing between at least one other adjacent pair of shaped surfaces. Preferably, the difference between any two unequal spacings is greater than the manufacturing tolerances at which adjacent shaped surfaces can be spaced.

The axial alignment means referred to above for aligning the hub with a drive means can comprise at least one annular groove disposed in the base portion of the hub and a hole in the annular groove. The drive means is provided with an alignment pin located so that the print element will be properly axially aligned when the pin of the drive means is received in the hole of the hub. The groove in the hub slidingly receives the alignment pin of the drive means such that when the pin is in the annular groove, the shaped surfaces of the drive means and the hub are not in R engagement and the hub and drive means can be relatively rotated with the pin sliding in the groove until the pin and groove are registered. The pin can then enter the hole and allow the shaped surfaces of the hub and drive means to engage. The tip of the pin is preferably rounded to facilitate sliding in the groove. According to an embodiment of the invention, the pins can be used to transmit torque to the hub via the alignment holes in cooperation with the torque applied via the shaped surfaces.

The hub is preferably made of metal by a progressive forming and punching process. The hub can be made as a separate piece for attachment to radial elements carrying print characters, or the hub can be formed integrally with radial elements.

In accordance with another aspect of the invention, means for coupling a rotary print element to a motor are provided which cooperate with the hubs described above. According to one embodiment, the coupling means include a hub having thereon a plurality of shaped surfaces which engage the plurality of correspondingly shaped surfaces on the print element hub. The hub of the coupling means includes a base portion and a peripheral portion connected to the base portion extending transversely therefrom. The shape of the coupling means hub is similar to the shape of the print element hub and the shaped surfaces on the print element hub and the coupling means hub are located so as to engage when the print element hub is seated and aligned on the coupling means hub. Thus, the peripheral hub portion of the coupling means hub extends at an angle from the base portion which is generally the same as the angle at which the peripheral portion of the print element hub extends from its base. The shaped surfaces are distributed, either uniformly or non-uniformly, in correspondence with the shaped surfaces of the print element hub, and the shaped surfaces have a cross section corresponding to that of the shaped surfaces of the print element hub. The coupling means hub includes the alignment pin referred to above. More than one alignment pin and groove can be provided, and the number of alignment pins in the coupling means hub and the number of grooves in the print element hub correspond in number and radial location, with the hole in each groove corresponding in circumferential position to that of the respective pin. At least three pins are preferred since the three pins define a stable plane on which the print element hub is supported during implacement.

Torque can also be applied to the hub by means of the holes in the hub which are engaged by the pins of the driving means. In such a case, at least one of the pins is preferably circumferentially adjustable so that two pins engage respective holes substantially without any free play. This permits torque to be applied via the holes without a dead zone and substantially without any backlash.

In accordance with another aspect of the invention, a radial element for a rotary print element is provided which comprises a central bar-or rod-like portion and a tip portion connected to the bar portion. Bar- or rod-like is used in a broad unlimiting sense to refere to that portion of the radial element radially inwardly of the tip portion. Other shapes such as a triangular cross-section are intended to be encompassed by the term "bar - or rod-like". This portion of the radial element resembles a spoke extending a hub or ring regardless of its precise shape. The bar- or rod-like portion may be referred to herein, for example, as a bar portion or a bar or as a spoke bar. The tip portion, or tip, has a surface portion integral with the tip which is struck by an impact element during printing. The tip is shaped to cooperate with the impact element during printing to align the tip and a character element carried by the tip. The tip, the shaped surface of the tip and the bar portion are a unitary, integral piece made of metal. The bar is flexible so as to flex when the tip is struck by the impact element. The impact-receiving shaped surface portion of the tip preferably comprises a substantial part of a surface of the tip defining a side of the tip. Providing the shaped surface as an integral part of the tip eliminates the need for a separate strike pad, and with it an additional mass at the tip of the radial element An integral shaped portion also improves service life over an adhered plastic strike pad.

The impact-receiving shaped surface portion defines a volume adapted to receive a correspondingly but oppositely shaped portion of the impact element. Preferably, the shaped surface portion defines either a concavity or a convexity, and the shaped portion of the impact element is oppositely shaped. Providing a convex/concave mating arrangement distributes the impact energy of the impact element over a wider area of the character face for improved printing and at the same time facilitates alignment of or "self-aligns" the tip during printing. In accordance with one embodiment, the shaped surface portion includes a peripheral portion, a base portion and an intermediate portion connecting the peripheral portion and the base portion, the peripheral, intermediate and base portions being joined and shaped so that the shaped portion of the impact element engages the peripheral portion and the base portion, but not the intermediate portion.

In accordance with one embodiment, the tip is generally overall convex on a side thereof in which the impact-receiving shaped surface is disposed, and generally overall concave on an opposite side of the tip. A character element is secured to the opposite side of the tip. Preferably, the character element is secured by a material disposed between the character and the tip. The material is preferably one which is impressed on the tip by a casting process, or alternatively a bonding material such as an adhesive or epoxy. The character element itself together with the securing material can be a cast plastic having a raised character face. Preferably, an opening is provided in the shaped surface to communicate opposite sides of the tip, and the material securing the character to the tip or the cast plastic material extends through the opening from one side of the tip to the other. The securing or cast plastic material thereby is interlocked to the tip by the opening. In addition, it is preferred that the securing or cast plastic material extend about the periphery of the tip from the concave side of the tip to the convex side of the tip.

As indicated above, the radial elements can be formed integrally with the hub portion or separately and joined to the hub portion. When formed integrally with the hub portion, the hub and the radial elements are made from the same sheet of metal. The hub and radial elements including the tips are formed by successive forming and punching steps. When the hub and radial elements are formed separately, the radial elements are formed by a forming operation and are held together by a ring. The ring is then joined to the periphery of the separately formed hub, for example by a welding process or by swagging.

A print element, according to the invention disclosed herein, can be rotated at higher accelerations to achieve higher printing speeds. This is made possible by reducing the overall rotary moment of inertia of the print element and/or drive coupling apparatus, and/or providing improved damping and restraining structures for the radial elements of the rotary print element which reduce or prevent unwanted motional and/or torsional excursions of radial elements while reducing or not adding substantially to the rotary moment of inertia of the print element, and/or providing a hub for the print element which receives torque from a driving arrangement substantially uniformly about its peripheral portion.

In addition, the invention provides for a transfer of driving torque to the print element hub substantially uniformly about its periphery with substantially even stresses throughout, and thereby preventing undue stress concentration points where wear cracks can otherwise develop under high speed accelerations encountered during high speed printing.

The invention also facilitates automatic "hub-up" of a print element on a printing apparatus operating shaft. Manual placement is also possible in accordance with the invention, but without the need to precisely position the print element to obtain proper alignment.

The invention further enables precise registration of print characters by providing for precise alignment of an impact element and a radial element tip carrying the character in a fixed impacting path of the impact element.

A thin print element hub profile is possible in accordance with the invention which is not thicker than present plastic hubs. Since print elements are stored in a nested relationship, thin hubs enables a nested stack to contain as many print elements as possible in a minimum nested length.

The invention provides a metal print wheel hub to which plastic radial elements as well as metal radial elements can be attached.

A hub, according to the invention, includes space thereon for print wheel identification data. For example, a label can be affixed to the "outboard" side of the hub.

In accordance with the invention, axial alignment of the print element is not determined by the torque receiving surfaces on the print element. This allows axial alignment of the print element on more than one axis and simplifies the print element placement procedure.

A shaped radial element tip in accordance with the invention provides an impact area having improved wear characteristics, as well as an improved impact distribution over the entire character face.

The invention provides methods which enable the print elements and components thereof such as the tip portions to be manufactured relatively inexpensively.

The invention also enables special print elements to be fabricated inexpensively and quickly.

The invention also provides such print elements and components thereof which enable high quality printing at increased printing speeds.

The above and other objects, features, aspects and advantages of the present invention will be more readily IR perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIG. 3 is a side perspective view of the engager hub of FIG. 2;

FIG. 10 is a front perspective view of different width spoke tips which can be carried by the print wheel of FIG. 1 and used for proportional space printing, wherein

FIG. 11 is a side perspective view of the base die frame of a modular press forming die for forming spoke tips, depicting insertion points for mounting die insert halves for forming standard width spoke tips for standard, fixed spacing or variable width spoke tips for proportional spacing;

FIG. 12 is a schematic view showing a die insert half for the die frame of FIG. 11 for standard spacing;

FIG. 13 is a schematic view showing die inserts halves for the die frame of FIG. 11 for proportional spacing.

DESCRIPTION OF THE PREFERRED EMBODIMENTS

Figure 1:
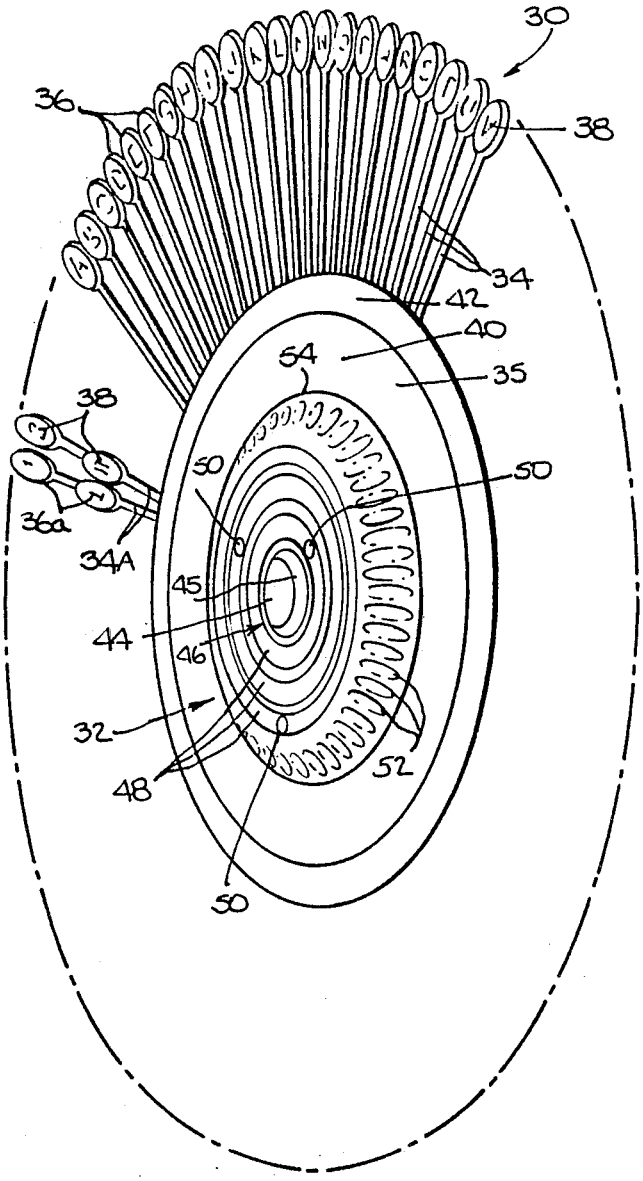
FIG. 1 is a perspective, generally schematic view of a print wheel according to the invention.
Figure 2:
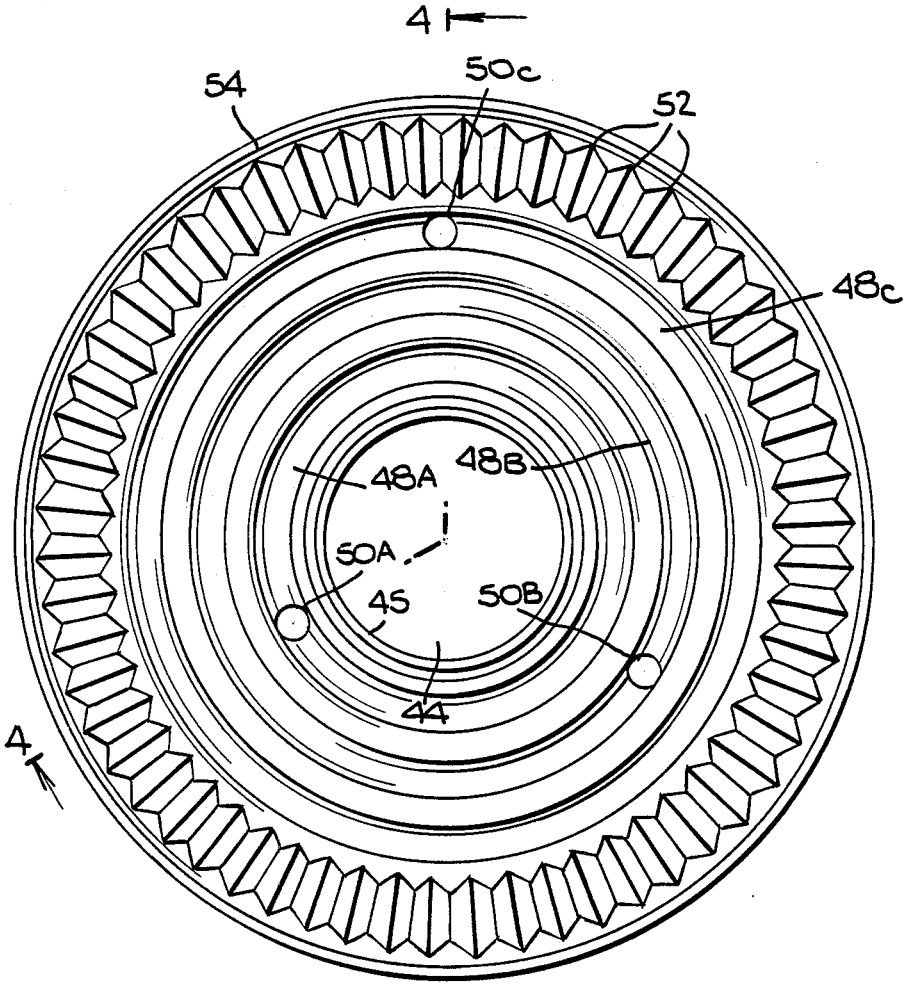
FIG. 2 is a front plan view of the central engager hub of the print wheel of FIG. 1.

Referring first to FIGS. 1 and 2, a print element in the form of a print wheel 30 according to the invention is depicted which includes an engager hub 32 disposed at the center of the print wheel by means of which the print wheel can be mounted to and driven by a drive shaft (not shown) to rotate the print wheel and thereby achieve character selection. A multiplicity of radial elements in the form of spokes or spoke elements extend radially outwardly from the hub 32. The radial elements can extend from the hub or a ring normal to the central axis of the hub or ring or at an angle thereto The spoke elements comprise a central bar-or rod-like portion 34 extending from a ring or spider 35 having a central opening which is coaxially disposed with respect to the engager hub 32 and connected thereto. Secured to the tip 36 of each bar-like portion, or spoke bar, is at least one character element 38. Spoke bars 34 are shown to be carrying a single character element 38 while spoke bars 34A are shown to be carrying two spoke tips 36A and two character elements 38, and can be referred to as dual character spoke bars. The spoke bars 34, 34A are mounted to the spoke ring 35 so as to be displacable in a generally axial direction relative to the spoke ring 35 and hub 32 upon being impacted by an impact element or hammer, as generally shown in FIG. 15. The direction followed by the spoke bar during printing could also be radial depending on the angle at which the spokes extend from the hub or spoke ring. The spoke bars 34, 34A and spoke ring 35 can be formed separately from the engager hub 32 and subsequently connected thereto, or they can be formed as a single unit with the engager hub as will be described more fully below. While it is preferred that the engager hub 32 be made of pressed metal, the spoke bars 34, 34A and spoke ring 35 may be made either of metal or plastic, depending on service life and print quality requirements of the particular print wheel.

Whether the spoke bars 34, 34A and spoke ring 35 are secured to the engager hub 32 as separate parts or formed integrally with the engager hub, in accordance with an aspect of the invention, a damping structure 40, shown schematically in FIG. 1, can be disposed adjacent the connection of the spoke ring to the hub extending over both the spoke ring and a root or base portion of the spoke bars to provide motional restraint of the spoke bars. Adjacent to and radially outwardly of the damping structure 40 can be disposed in accordance with another aspect of the invention a restraining structure 42 connected to the spoke bars. The restraining structure 42 also provides motional restraint of the spoke bars. The damping structure and the restraining structure when utilized extend circumferentially as concentric annuli beyond the periphery of the engager hub 32. The damping structure primarily restrains the motion of the spoke bars in the axial direction of the spoke wheel while the restraining structure primarily restrains torsional motion of the spoke bars, and are described more fully below in connection with FIGS. 14–20.

Figure 4:
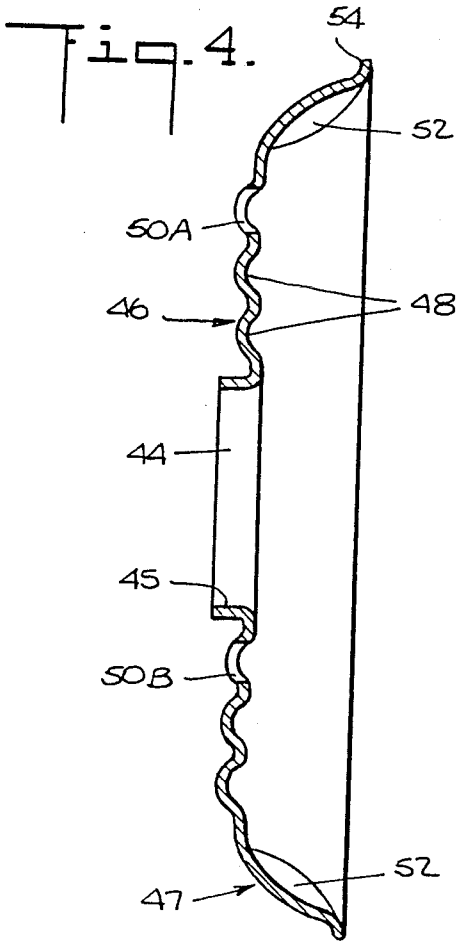
FIG. 4 is a section view of the engager hub of FIG. 2 taken along line 4—4 in FIG. 2.

Still referring to FIGS. 1 and 2, and also to FIGS. 3 and 4, disposed at the center of the engager hub 32 is a hub hole 44 for mounting the print wheel 30 to a drive shaft of a drive arrangement for rotating the print wheel. The central hub hole 44 is surrounded by a rim flange 45 (FIG. 4), the inner periphery of which defines the outer periphery of the hub hole 44. As shown in FIGS. 3 and 4, the engager hub 32 includes a bottom portion 46 extending generally in a plane and a peripheral portion 47 extending transversely from the bottom portion. Radially outwardly of the rim flange 45 in the bottom portion 46 are disposed a plurality of concentric, circumferentially-extending grooves referenced generally in FIG. 1 by 48. Three grooves 48A, 48B and 48C are provided in the engager hub depicted in FIGS. 1–4. Each groove is shown to have the same radial extent or width, and is of generally semi-circular cross section, although other configurations are possible. In each of the annular grooves 48A, 48B, 48C is disposed a hub alignment hole generally referenced by 50, i.e. 50A, 50B, 50C, respectively, located along respective radii spaced 120° apart.

Disposed at the periphery of the engager hub 32 in the peripheral portion 47 thereof are a multiplicity of shaped surfaces in the form of engager rim teeth 52 (or engager fan teeth as they resemble a folded fan) by means of which a rotational drive force is applied to the engager hub. The fan teeth are preferably triangular in cross section, although they can be arcuate, trapezoidal, rectangular or square in cross section or of other configurations. A hub rim 54 defines the outer periphery of the engager hub with the engager fan teeth being located radially inwardly of the hub rim. The engager fan teeth 52 are shown to continuously extend circumferentially about the engager hub, although spaces can be provided between adjacent engager fan teeth, or engager fan teeth can be provided in sets of adjacent teeth with the sets uniformly or non-uniformly spaced circumferentially about the periphery of the engager hub. Other arrangements of engager fan teeth are, however, also possible. The purpose of the circumferential grooves, the hub alignment holes and the fan teeth will be described more fully below in connection with FIGS. 5 and 6.

The engager hub thus resembles a tiny pie pan in that the bottom portion 46 of the hub is generally flat, has radial symmetry about a central axis passing through the hub hole 44, and the peripheral portion 47 extends transversely from the flat bottom portion 46 at a chosen angle ranging from about 90° to about 165°.

According to a preferred embodiment, the engager hub 32 is punched and pressed from thin sheet metal into the pie pan shape depicted in FIGS. 3 and 4. The central hub hole 44 and the alignment holes are punched, the rim flange 45, the engager fan teeth 52, the outer hub rim 54 and the concentric grooves 48 are formed by progressive pressing operations. The engager fan teeth and the outer hub rim 54 stiffen the peripheral portion 47 of the hub while the concentric grooves stiffen the bottom or central portion 46, in addition to providing other functions described below. As a result, the engager hub 32 can be made of relatively thin metal and yet have sufficient stiffness to allow use of the engager hub as a center for cast on plastic spoke elements, or for use with metal spoke elements. A print wheel having metal spoke elements is preferably made with the spoke bars, spoke ring and engager hub as an integral unit. This can be done by progressively blanking the unit from a single piece of sheet metal, i.e. by forming the hub, the spoke ring and bars from sheet material in separate operations for the hub, as described above, and further punching and pressing operations for the spoke ring and bars.

It is preferred that the hub thickness be about 1/20 of its overall diameter. By way of example, the hub diameter can be about one inch and its unformed thickness about 0.005 inch to 0.05 inch. The overall formed thickness of the engager hub 32 can be up to about 0.160 inch, the axial width of the rim flange 46 can be about 0.130 inch, and the fan teeth 52 can extend at an angle of about 45 degrees with respect to the central axis of the hub, or 135° with respect to the flat bottom portion 46. The radial width of the lR grooves 48A, 48B and 48C and the size and number of the fan teeth can be dimensioned accordingly.

As a more specific example, the engager hub can have an outer diameter of about 1.020 inch and be formed from steel sheet having a thickness of about 0.010 inch to have a stamped cross-section maximum thickness (overall) of about 0.160 inch. The fan teeth can be impressed at a nominal 45 degree angle, as indicated above, with a nominal depth between crest and valleys of 0.060 inch. The central hub hole can be from about 0.250 inch to about0.280 inch depending on the drive shaft diameter it is to be used with, and can be upset punched to form the rim flange 45. The three annular grooves 48 can be of essentially semi-circular cross-section, as indicated above. The alignment holes 50 can be of 0.60 inch nominal diameter punched through the base of the grooves, at 120 degree separation, one hole per groove. The outer rim 54 can be from 0.020 inch to 0.030 inch high pressed into the periphery of the hub 32. The radial extent of the spoke ring or spider 35 can be about 3/16 inch. Forming, the spoke ring in one piece with the hub eliminates the need to secure the spoke ring to the hub, and with it, the weight of the material used to secure the spoke ring to the hub.

It is preferred that a low coefficient of friction coating, such as Teflon Type "S" be applied to the hub, particularly the grooves 48. If the coating can "take" the stamping, strain-relief heat treatment, and reverse side de-scale and protective plating, the coating may be applied to the "raw" sheet stock so as to ease the die closure pressures required. If the low friction coating will be damaged in the forming process, then the coating can be applied after forming, heat treating, and surface preparation stages. It is also preferred that the finished hub 32 retain its initial magnetic properties for reasons discussed in connection with FIG. 6 below.

As indicated above, all-plastic spoke elements (including a plastic tip and character element) or metal spoke elements having a metal tip to which a plastic character element is secured, as described below in connection with FIGS. 7–9, can extend from the engager hub described herein.

All-plastic spoke elements can be molded onto the metal hub described herein by a molding process which forms a spoke ring directly onto the rear (i.e. the part facing away from a driving arrangement) of the peripheral portion 47 of the metal engager hub. The plastic spoke ring can have a radial extent of about 3/16 inch outwardly of the outer rim of the hub with sufficient overlap with the hub peripheral portion to engage the plastic with the fan teeth extending about the hub. The alignment holes in the hub can mate with pins in the molds to insure that the spokes and spoke ring will be properly aligned. A 45° fan teeth shape provides an excellent engaging and interlocking surface for the plastic spoke ring.

As indicated above, the metal hub and metal spoke elements can be formed integrally or separately. When formed separately, the spoke bars and the spoke ring can be blanked from metal sheet, generally as described above for the integral hub and spoke elements, and thereafter joined to the hub, as by discharge welding. It is preferred that a separately-formed spoke ring and spoke bar be made of a pre-hardened, springy, yet durable metal, such as phosphor-bronze or spring steel, whose characteristics preclude its use for the hub due to the relatively deep shape to which the hub must be drawn. One method of securing the spoke ring to the metal hub is as follows. A first thin metal washer-like gripping surface having a diameter and radial extent sufficient to overlap the fan teeth on the rear of the hub and extend therefrom about 0.015 inch to about 0.020 inch is discharge welded to the hub. Thereafter, the spoke ring, after being properly aligned using alignment holes, for example, is discharge welded to both the first gripping surface and the fan teeth on the hub. Then a second metal washer-like gripping surface, similar to the first, is discharge welded to the spoke ring and the hub fan teeth. The two washer-like gripping surfaces sandwich the spoke ring so as to provide a greater bonding surface area of the spoke ring to the hub than would be obtained by only welding the spoke ring to the hub. According to another method for securing metal spokes to the hub, the spoke ring can be swaged onto the hub peripheral portion and cold-welded thereto, with the fan teeth providing an excellent interlocking surface for the spoke ring.

Figure 5:
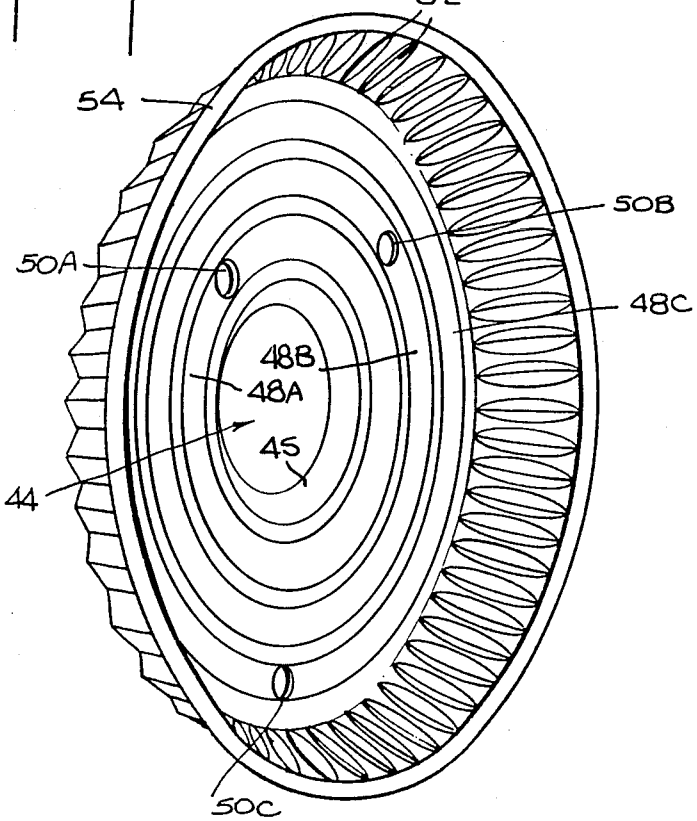
FIG. 5 is a side view partially in section and partially cut away of the engager hub of FIG. 2 mounted to a drive shaft by mechanical latching means.
Figure 5:
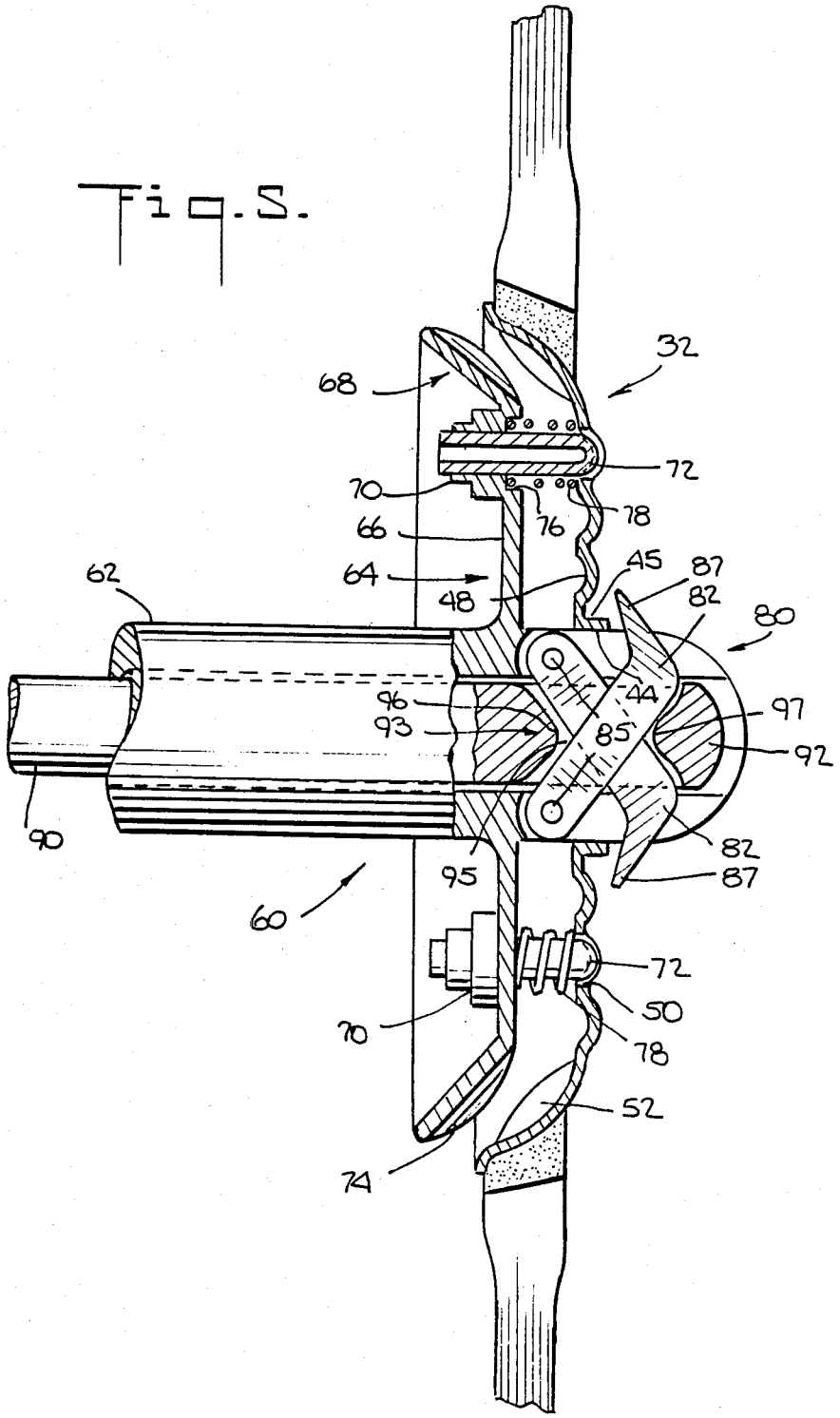

Referring now to FIG. 5, the engager hub 32 of FIGS. 1–4 is shown mounted to a drive mounting arrangement, or mechanical chuck, referenced generally by 60, which is in turn secured in a printing apparatus so as to be rotated by a drive motor (not shown). The chuck 60 includes a tubular drive shaft 62 which is rotatably driven by the drive motor.

Connected concentrically to the drive shaft 62 of the chuck is a hub 64 which is similar in overall shape to the engager hub 32. The chuck hub 64 includes a bottom portion 66 extending generally in a plane, and a peripheral portion 68 extending transversely from the bottom portion generally at the same angle as for the peripheral portion of the engager hub 32. The bottom portion 66 is shown to be flat and includes a number of mounting receptables 70 in each of which is fixed an alignment pin 72. The receptacles and pins correspond in number and location to the number and location of the alignment holes 50 in the engager hub 32. R Thus, the mountings and pins are disposed centered on concentric circles corresponding to circles centered in grooves 48 in the engager hub 32 on respective radii spaced 120° apart. Three pins and holes have been selected since the tips of three pins define a plane for the engager hub which is parallel to the plane of the bottom of the chuck hub.

The three pins thereby stably support the engager hub in a plane during emplacement of the print wheel. Disposed in the peripheral portion 68 of the chuck hub 64 are engager rim or fan teeth 74 corresponding in number, configuration R and location to those of the fan teeth 52 of the engager hub 32. When the engager hub 32 is seated on the chuck hub 64, as described below, the fan teeth of the two hubs mate so as to firmly couple the two hubs. Thus, any rotation of the chuck hub will similarly rotate the engager hub.

The chuck pins 72A, 72B and 72C are received in the engager hub alignment holes 50A, 50B and 50C, respectively, when the engager hub is slipped onto the drive shaft 62 of the chuck and properly aligned. Alignment of the pins and holes is obtained by relatively rotating the engager hub and the chuck hub while the engager hub is on the chuck drive shaft. The chuck alignment pins 72 each include a rounded tip to facilitate sliding between the engager hub and the pins while the chuck pins are being aligned with the engager hub alignment holes. A recess 76 is provided in the chuck hub surrounding each of the chuck alignment pins to form an annular seat in which an end of a coil spring 78 coaxially disposed over a respective pin is retained. The coil spring extends axially along the pin terminating in advance of the rounded tip of the pin. The rounded tip of a respective pin rides in a respective engager hub groove 48 until the pins and hub alignment holes are registered. At that time, the engager hub is pressed onto the chuck so that the respective pins enter the respective holes and the free ends of the coil springs bear against the bottom portion of the engager hub about the respective hole.

The hub portion 64 of the mechanical chuck 60 is formed of thin, lightweight material to keep the rotational moment of inertia of the chuck as low as possible. The chuck alignment pins 72 are preferably hollow and made of a lightweight material also for the purpose of keeping the rotational moment of inertia of the chuck as low as possible.

The mechanical chuck 60 includes a mechanical latch referenced generally by 80 mounted to the chuck drive shaft 62. The mechanical latch 80 includes at least two gripper latches or arms 82 which are each pivoted at one end to the drive shaft 62 by pins 85. The gripper latches extend from the pins into the interior of the drive shaft 62 and then passing through the drive shaft, protrude exteriorly of the drive shaft in a generally hook-shaped ends. The hook-shaped ends 87 of the gripper latches axially engage and retain the engager hub on the chuck hub.

Disposed interiorly of and coaxially with the drive shaft 62 is an internal operator shaft 90 which is secured in the printing apparatus to rotate with the drive shaft 62 and axially movable relative to the drive shaft 62. For example, both the drive shaft 62 and the internal shaft 90 can be separately coupled to the drive motor, or one can be coupled to the drive motor and the two coupled together, as for example by a spline arrangement. The shaft 90 terminates in a nose portion 92 which is connected to a main portion 93 of the shaft by an intermediate portion 95. The intermediate portion is slotted so as to freely pass to the sides of the gripper latches 82. The end 96 of the shaft main portion 93 and the end 97 of the nose portion 92 adjacent the intermediate shaft portion 95 are rounded so as to form camming surfaces.

The respective camming surface of the shaft 90 engages the central portion of the gripping latches when the shaft 90 is moved in a respective axial direction relative to the drive shaft to cause the gripping latches to pivot in a respective direction.

The procedure for mounting a print wheel to the drive chuck will now be described. The engager hub 32 is slipped onto the drive shaft 62 with the flange rim 45 of the engager hub opening 44 either contacting the ends 87 of the gripper latches 82, if they have not been retracted, or past the gripper latch ends if they have been retracted. The gripper latches 82 are retracted into the chuck drive shaft 62 to enable the engager hub rim flange 45 to be axially moved on the chuck drive shaft past the retracted gripper latches. Retraction of the gripper latches 82 is accomplished by axially moving the internal shaft 90 into the drive shaft 62, i.e. axially retracting the internal shaft into and relative to the chuck drive shaft. Axial movement of the internal shaft 90 out of the drive shaft 63 causes the camming surface on the end 96 of the main shaft portion 93 to engage the gripper latches, and pivot them, thereby causing the gripper latch ends 87 to be retracted into the chuck drive shaft. When the engager hub rim flange 45 clears the retracted ends of the gripper latches, the internal shaft is axially moved in a direction into the chuck drive shaft so that the camming surface at the end 97 of the shaft nose portion 92 engages the gripper latches and pivots them, thereby causing the gripper latch ends 87 to protrude from the chuck drive shaft 62. At this time, the chuck alignment pins 72 are seated in respective grooves 48 of the engager hub. The pins are of a height such that the fan teeth of the two hubs do not engage when the pins are in the grooves. Relative rotation of the engager hub 32 and drive chuck 60 will cause the chuck pins 72 to ride in the grooves until they are registered with respective engager hub holes 50, at which time the engager hub 32 is drawn onto the drive chuck hub 64. By urging the internal shaft 90 axially into the drive shaft 62, the camming surface on the end 97 of the drive shaft nose portion 92 engages the grippper latches so that the ends 87 of the latches engage and exert an axial force on the rim flange of the engager hub. This force causes the engager hub to be drawn onto the chuck hub when the pins and holes are registered. To facilitate relative rotation between the engager and chuck hubs while this axial force is being exerted, the tips of the pins are rounded, as discussed. Also, the pins are preferably made of a low coefficient of friction material and the grooves 48 of the engager hub are coated with a low coefficient of friction material, as indicated above. When the pins 72 enter the holes 50, coil springs 78 are compressed between the two hubs and thereby resiliently urge the engager hub away from the chuck hub into further engagement with the gripper latches.

When the engager hub is drawn onto the chuck hub, respective fan teeth of the two hubs engage. Further force on the internal shaft pivots the gripper latches harder and causes the chuck fan teeth and the hub fan teeth to engage. Thereafter, only a light axial retention force is required on the internal shaft to maintain the teeth engaged. Rotary motion is transmitted from the chuck hub to the engager hub through the interlocking fan teeth of the chuck hub and the engager hub. The driving force is thus distributed about the circumference of the chuck hub and the engager hub. The chuck alignment pins preferably are used for alignment only and not to transmit driving force from the chuck hub to the print wheel hub. Torque from the rotating drive shaft 62 is thus transmitted to the engager hub essentially soley by engagement of respective fan teeth. Essentially no rotational forces are transmitted by the pins 72 or the gripper latches 82 to the engager hub. As a result, these parts can be made relatively light weight to reduce rotary moments of inertia, and the pins can be hollow, as mentioned above.

According to an alternate embodiment, the pins can be used to transmit driving torque to the hub via the holes 50 in cooperation with, or in substitution for the torque applied via the fan teeth. In such a case, the pins are solid and at least one of them is circumferentially adjustable or movable for taking up any free play between holes.

When the engager fan teeth of the two hubs engage, a precise alignment is obtained between the serrated peripheral surfaces of the two hubs. The two hubs can be engaged on only a single alignment axis due to the alignment pins and holes and the engagement of the respective fan teeth. Thus, it is not necessary that the respective teeth be universally engageable on any other axis. As a result, the fan teeth on the two hubs can be non-uniformly spaced, etc., as described above, as long as there is correspondence between the two mating sets of fan teeth about this one axis. This is quite different from "poker chip" engager surfaces intended for universal engagement on a plurality of axes.

To remove the engager hub from the chuck hub, the internal shaft 90 is axially moved out of the drive shaft 62 so that the camming surface of the main shaft end 96 engages and pivots the latches to retract their ends into the drive shaft The compressed coil springs 78 then thrust the engager hub away from the chuck hub, and the print wheel may then simply be lifted off the chuck.

The rotary print wheel can be seated and aligned on the hub, and removed from the chuck hub, manually by manually causing the internal shaft 90 to move axially relative to the drive shaft, and by manually rotating the print wheel relative to the chuck hub to seat the pins. For example, the nose 92 of the internal shaft may be made accessible and can be used to push and pull the internal shaft. Means not shown can be provided to lock the internal shaft in a given position. The rotary print wheel can also be seated and aligned automatically by providing means (not shown) to automatically axially move the internal shaft and relatively rotate the engager and chuck hubs. For example, a cam element can be fixed in the printing apparatus at a predetermined location, for example an extreme end of travel of the print carriage. The internal shaft can include a camming surface which cooperates with a camming surface of the cam element to axially move the internal shaft as described above when the print carriage is moved into the predetermined position. Such automatic means can further include a gripper located at the predetermined position along the travel of the print carriage which retards rotation of the engager hub while the chuck hub is being rotated until the chuck pins enter the engager hub holes. The automatic means can also automatically cause the camming surfaces to engage to move the internal shaft when it is desired to remove the print wheel.

Figure 6:
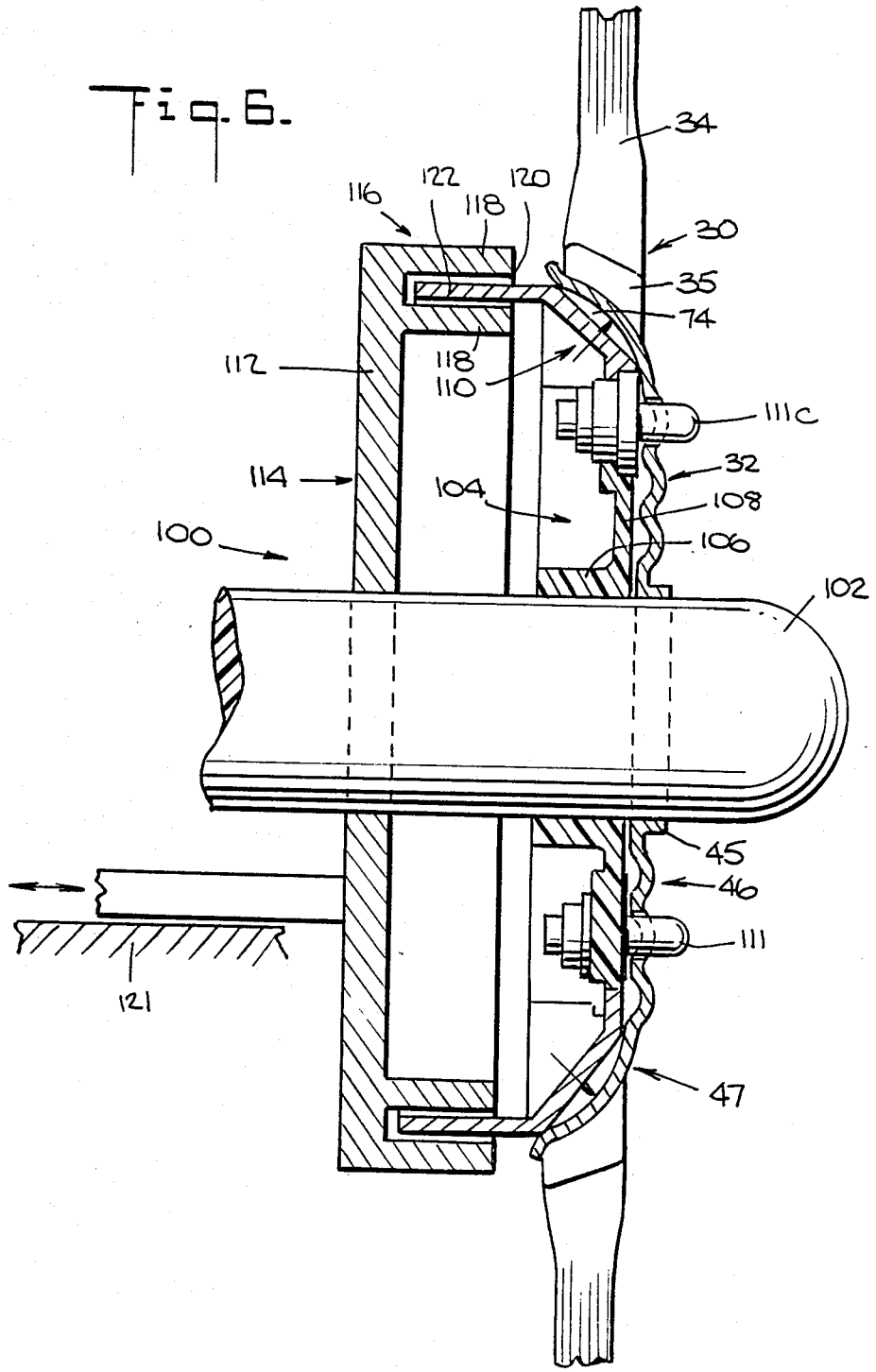
FIG. 6 is a side view partially in section of an engager hub according to another embodiment of the invention mounted to a drive shaft by magnetic means.

Referring to FIG. 6, another arrangement for mounting the print wheel to a drive motor is illustrated. The drive mounting arrangement, or magnetic chuck, designated 100 in FIG. 6, secures the print wheel 30 magnetically to a hub of the magnetic chuck for rotation by the drive shaft 102. The engager hub 32 depicted in FIG. 6 is similar to the engager hub depicted in FIGS. 1–5 and is made of a magnetically attractable material, such as a ferrous metal. The chuck 100 includes a hub 104 having a central collar 106, a bottom portion 108 preferably made of a non-magnetic material, for example aluminum or plastic, and a peripheral portion 110 made of a magnetically attractable material, for example a ferrous metal. The bottom portion lies generally in a plane and the peripheral portion extends transversely from the bottom portion. The collar portion and the drive shaft are keyed (not shown) so that the hub 104 rotates with the drive shaft. The bottom portion 108 includes non-magnetic alignment pins 111 disposed as described for mechanical chuck 60. Fixed in the printing apparatus against rotation is a magnet structure or magnet holder 112 having a base portion 114 extending generally in a plane and a peripheral portion 116 comprising concentric annular rings 118 extending transversely from the base portion and spaced apart to form a annular space or gap 120. The annular space 120 is sized to receive the extremity or a rim extender 122 of the peripheral portion 110 of the chuck hub 104.

The magnet structure 112 is secured to a print carriage frame 121 which holds all of the translatory elements of the printer, so that the magnet structure does not rotate with the drive shaft 102 to keep rotational moment of inertia low, but is slidable axially with respect to the drive shaft and the print carriage frame. The central portion of the chuck hub 104 from the outermost chuck alignment pin 111C inwardly is preferably formed of non-magnetic material, as mentioned above. Two diametrically opposite regions of the peripheral portion 116 of the magnet structure 112 are arranged to have different magnetic polarities so that the magnetic flux flows radially outwardly on one side of the magnetic structure through the radial space or gap 120 to the rim extender 122 of the chuck hub. Since magnetic flux cannot flow through the non-magnetic inner portion of the chuck hub, the flux must flow through the engager hub, which is made of magnetically attractable material, on one side of its peripheral portion 47 into its bottom portion 46. The flux flows through the engager hub, then to the rim extender 122, then through the radial gap 120 and through the annular rings 116, 118 to the opposite pole on the magnet structure 112. When one or more pairs of opposite poles are provided at diametrically opposite portions of the magnet structure, the magnetic flux flowing in the chuck hub peripheral portion will provide an axial retention force to the engager hub acting along the direction of the arrows designated 123 through the engager fan teeth.

To mount the print wheel to the chuck, the flow of magnetic flux in the magnet structure 112 and/or the rim extender 122 is interrupted. The engager hub is then mounted to the drive shaft and relatively rotated with respect to the chuck hub until the alignment pins enter the hole in the engager hub. The magnetic flux is then caused to flow in the magnet structure and/or the rim extender, thus creating the magnetic attraction force between the fan teeth of the two hubs which draws and holds them together. The engager teeth of the two hubs engage, and rotary driving force is transmitted to the engager hub, as described above in connection with the mechanical chuck 60.

When the print wheel is to be removed, the flow of magnetic flux in the magnet structure 112 and/or the rim extender 122 is interrupted to remove the magnetic attraction force between the chuck hub peripheral portion and the engager hub allowing the print wheel to be lifted off the chuck hub. If desired, springs could be coaxially mounted relative to the pins to provide a thrust, as described above in connection with the mechanical chuck, when the magnetic attraction force is terminated.

The flow of magnetic flux in the magnetic structure 112 and/or rim extender 122 can be interrupted by moving magnet units away from the magnetic structure and/or moving the magnetic structure away from the rim extender.

Since the magnet structure 112 does not rotate, magnet units can be mounted directly to the magnet structure without contributing to the rotary motion of inertia of the print wheel and magnetic chuck.

Magnet units or sources of magnetic flux for magnetizing the magnet structure 112 can be located at any portion of the magnetic flux path. A preferred location is in the annular ring 116. The top quadrant of the ring can be "north" and the bottom quadrant "south" with the two intervening quadrants (east-west) being made of non-magnetic material acting as pole isolators. Thus, as the structure rotates, the flux alternates through any section of the engager hub. From a stationary perspective, however, a nearly constant magnetic flux flow between the two stationary poles, north uppermost and south lowermost, results. It is preferred that the annular rings be used as the pole magnets since they are directly adjacent to a high reluctance air gap, but the pole pieces can also be located at the base portion 114 of the structure. Whatever portion is chosen, that portion can be formed as a magnetic unit.

Alternately, the structure 112–114 can be of nonmagnetic material, plastic for example, in certain regions of which magnetic ferrites are cast. Unmagnetized regions (or inclusion of iron laminates or powder slugs into precast receiver slots) can serve as flux conductors, but certain regions can have large concentrations of ferritic material which are converted to poles by application of heavy external magnetic fields.

Electromagnets can be used as sources so that movement of the magnet units or magnet structure is not necessary to establish and terminate the magnetic force securing the engager hub to the chuck. The electromagnet can be located directly on the magnet structure 112 or adjacent thereto on the print carriage. Since the magnet structure does not rotate, the use of a heavy electromagnet coil does not affect the rotary moment of inertia of the print wheel and magnetic chuck.

According to another embodiment, a saturable link is disposed in the magnetic flux path. Normally, permanent magnets produce a flow of flux sufficient to attract and hold the engager hub axially on the chuck. When release is desired, the saturatable link can be biased by an external field so that the field produced by the pole magnets is not conducted to the gap area 120. The magnets thus hold the print element on the chuck without external power and no motion is required. For example, an electromagnet can be mounted on the frame of the printer. The print carriage can traverse over to this mounting point and the moving print carriage therefore does not have to carry the weight of the coil of the electromagnet.

The flow of magnetic flux through the magnet structure 112 and/or the rim extender 122 can be interrupted and created manually or automatically. Manual operation can be accomplished simply by moving the magnet structure 112 or the magnet which magnetizes it. Automatic operation can be achieved by automatically moving the magnet structure, or magnets which magnetize it, and in addition, providing relative rotation between the engager hub and chuck hub during mounting.

In an automatic embodiment in which the magnet units are axially moved, an operating cam can be provided at a load/unload point of the print carriage, for example the extreme left point of travel, which pulls away the pole pieces from the magnet structure. In a manual system, a lever can be provided to operate such a cam.

Automatic operation can also be accomplished using electromagnets.

The bottom portion 108 of the chuck hub 104 has been described above to be made of non-magnetic material. However, the bottom portion can be made of magnetic material, preferably the same material as the peripheral portion. When the hub 104 is so constructed, magnetic flux will nonetheless flow between the chuck hub peripheral portion and the engager hub peripheral portion, as described above, to secure the engager hub to the chuck.

The printing wheels and chucks in FIGS. 5 and 6 have been illustrated in a vertical attitude, however, they can be disposed in any desired attitude in a printing apparatus.

Figure 7:
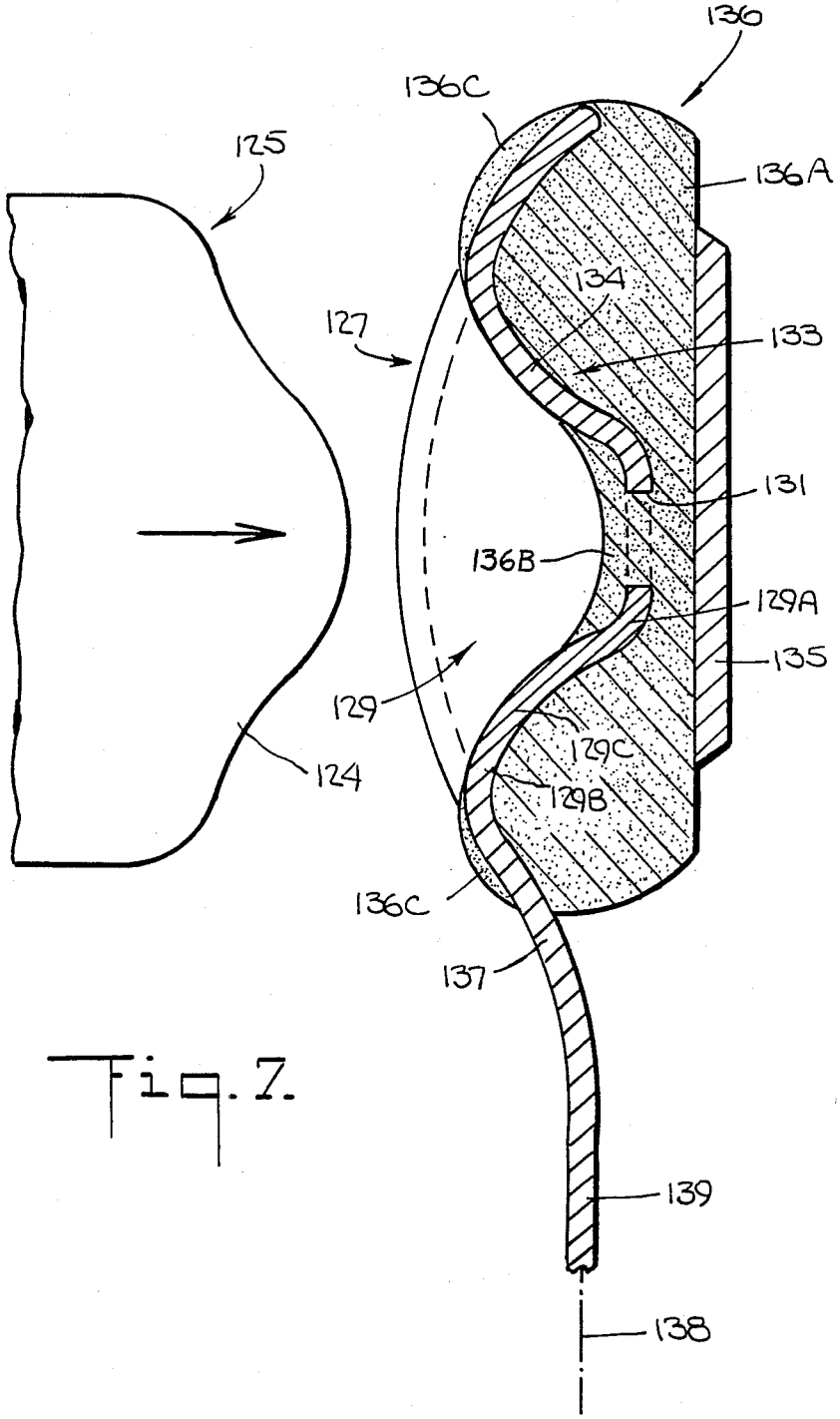
FIG. 7 is an enlarged section view taken longitudinally through the tip of one of the spoke elements of the print wheel of FIG. 1 and depicting the nose piece of an impact hammer about to strike the spoke tip.
Figure 8:
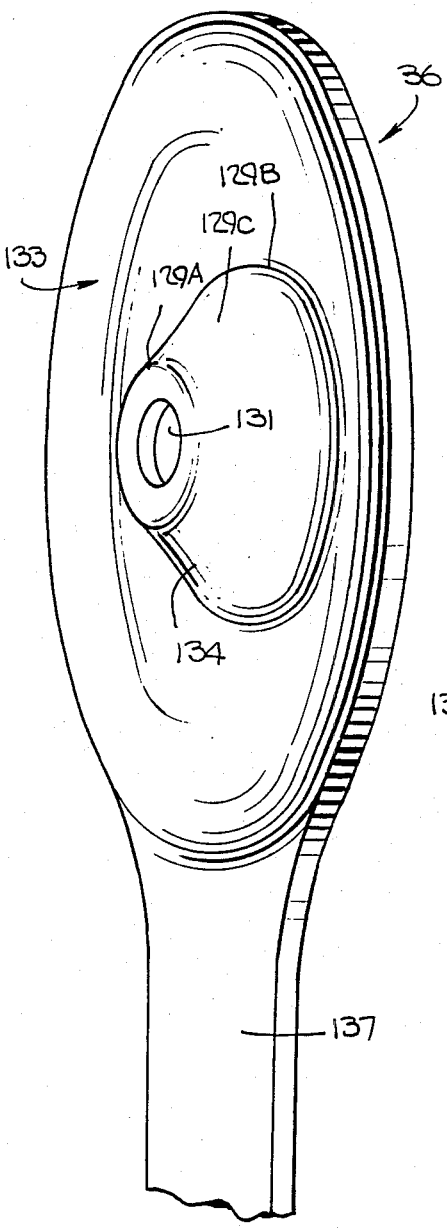
FIG. 8 is a front perspective view of the spoke tip of FIG. 7 without a character mounted thereto.
Figure 9:
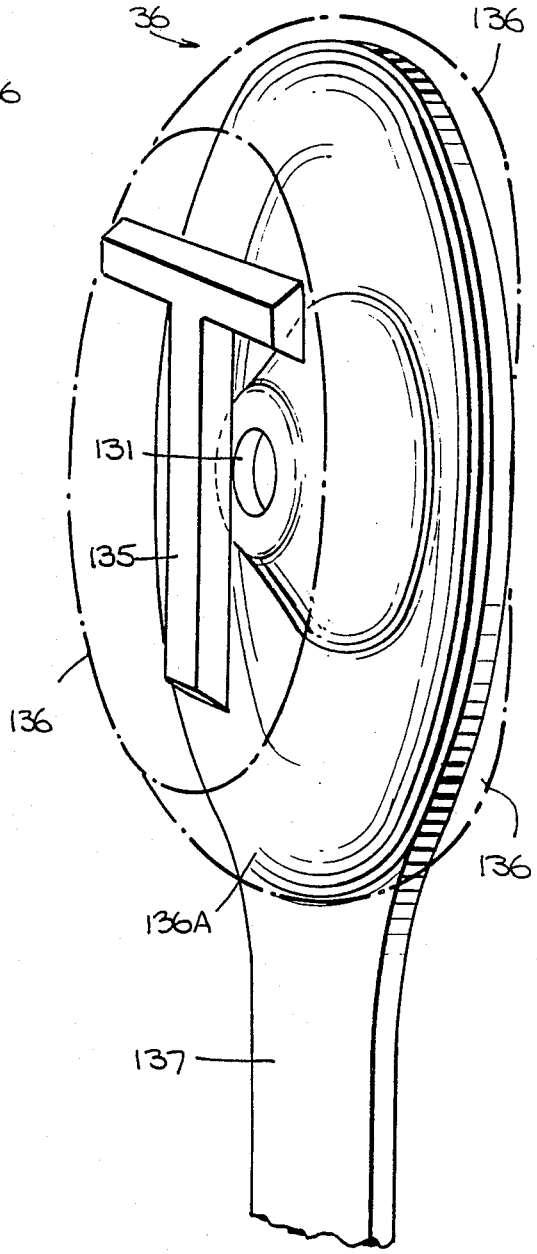
FIG. 9 is a front perspective view of the spoke tip of FIG. 7 having a character, shown to be transparent for clarity, mounted thereto.

Referring now to FIGS. 7–9, the tip 36 of a spoke element is illustrated which provides improved service life and print quality comparable to an all-metal character tip, as in a type bar typewriter. The spoke tip is shown about to be struck by the nose or tip of a hammer element 125. The spoke tip 36 includes on the rear 127 of the tip an impact zone 129 generally centered in the tip. In the embodiment depicted in FIG. 7, the impact zone is provided as a concavity, also designated by 129, to receive the tip of an oppositely-shaped, i.e. convex, hammer element tip. Alternatively, the impact zone 129 can be provided as a convexity and the tip of the hammer element can be provided as a concavity. Other mating shapes are possible, such as mating wedge shapes for example. A convex/concave or similar mating shape arrangement is preferred because it distributes the impact energy of the hammer over a larger area of the character for improved print quality and longer service life. In addition, such mating shapes provide improved alignment of the character along the hammer strike path during printing. Disposed in the impact zone concavity 129 is an eyelet or opening 131 passing through the spoke tip from the rear 127 to the front 133 thereof. In the front 133 of the spoke tip, as illustrated in FIG. 8, is a outer surface convexity 134 corresponding to the inner surface concavity 129 formed in the rear of the tip. The front 133 of the spoke tip is generally spoon-shaped as shown in FIG. 7, with the convexity 134 generally centered in the spoon. A character element 135 which can simply be a raised character face is secured to the front face of the spoke tip by a bonding material 136, or the character element 135 and material 136 can be a cast plastic, such as, for example, a graphite-strand-reinforced Nylon or a glass-reinforced phenolic material. In FIG. 9 the character element is shown transparent for clarity. The casting or bonding material portion designated 136A fills the space between the front of the spoke tip and the character face, with the material portion designated 136B passing through the eyelet to interlock the material and character face to the tip. The material portion designated 136C also extends about the periphery of the front of the spoke tip to the rear of the spoke tip, to provide further interlocking action for the material and character face, as shown in FIG. 7.

The spoke bar of a cast plastic spoke element is preferably formed with a substantially square or rectangular cross-section. A rectangular cross-sectioned cast plastic spoke bar preferably has a face which is about 1.2 to about 1.5 times the thickness of the bar. Cast plastic spoke bars of triangular and other cross-sectional shapes can also be used.

A metal spoke bar preferably has a rectangular cross section, the face of which is preferably at least about 2.5 times larger than the thickness. When the spoke bar and spoke tip are made of metal, they are usually formed from flat sheet metal stock having a thickness of from about 0.006 inch to about 0.010 inch by pressing and punching operations. A metal spoke bar is preferred because the spoke tip can be formed integrally therewith. For example, pressing operations can be utilized to obtain the concavity 129 and the spoon shape, and the eyelet 131 can be punched, preferably while the spoke tip is still flat. Integrally forming the impact zone 129 in the spoke tip eliminates the need for a cast on or otherwise secured rear pad, which would otherwise contribute to the rotary motion of inertia of the print wheel. Also, such an integrally formed impact zone made of metal can be stronger than a cast-on rear pad.

The entire print wheel can be formed from flat metal stock including the spoke bars and tips in a staged punching and pressing operation, as generally described above with forming steps added for the tip. Whether the entire print wheel including the hub and spoke bars is made from metal stock or the spoke bars and engager hub are made separately depends upon cost considerations, among other factors. Thus, the engager hub can be made from one piece of flat stock while the spoke bars and tips can be made from other flat stock. When the spoke bars and tips are made from one piece and the engager hub from another piece, an assembly of the spoke bars and engager hub can be made by swaging or discharge welding processes, for example as described above, in which fixation of the spoke ring to the engager hub is facilitated by the exterior ridges formed by the fan teeth. The joining area 137 of the spoke bar to the spoke tip is curved as developed, for example, in a press forming process so as to generally place the center of mass of the composite of the character element 135 and material 136 in a plane designated 138 passing through a central flat portion 139 of the spoke bar. The convexity or raised mound 134 in the center of the front of the spoke tip provides a good base for securing the character element to the tip. The cast plastic or bonding material 136 securing the character face to the tip protrudes (136B) through the locking eyelet during an application step (e.g. injection molding for cast plastic) against a mold stop (not shown) which is shaped to resemble an extended hammer nose piece, so that the shape of the concavity is maintained and yet the cast plastic or bonding material is permitted to pass through the eyelet into the concavity. This protrusion 136B of cast plastic or bonding material through the locking eyelet further aids retention of the character face on the spoke tip during the service life of the print wheel, which can represent millions of impact blows upon the impact zone concavity. The combination of an overall concave surface in which a convexity is located reduces the total amount of material required to secure the character to the tip, thus reducing the rotary moment of inertia of the tip. Preferably, the concavity 129 includes a base portion 129A, a peripheral portion 129B and an intermediate portion 129C connecting the base and peripheral portions. The concavity 129 is shaped so that an appropriately shaped nose piece 124 of the hammer 125 engages the concavity at its base 129A and peripheral 129B portions, but not its intermediate portion 129C. Other mating arrangements, for example wedges, are also possible. However, a convex/concave mating arrangement is preferred because it is relatively easy to form such shapes in the spoke tip. A mating arrangement, such as the one described above, insures that there is a precise engagement of the tip by the hammer nose piece, which reduces unwanted motional excursions of the spoke bar, as well as insuring that the character element is precisely aligned during printing, as discussed above.

For a tip integrally formed with a metal spoke bar having a tip width of about 0.060 inch and a tip length (i.e. height) of about 0.090 inch, the concavity 129 can be circular, as shown, having a diameter of about 0.030 inch, and the opening 131 can be circular having a diameter of from about 0.008 inch to 0.010 inch.

Figure 10C:
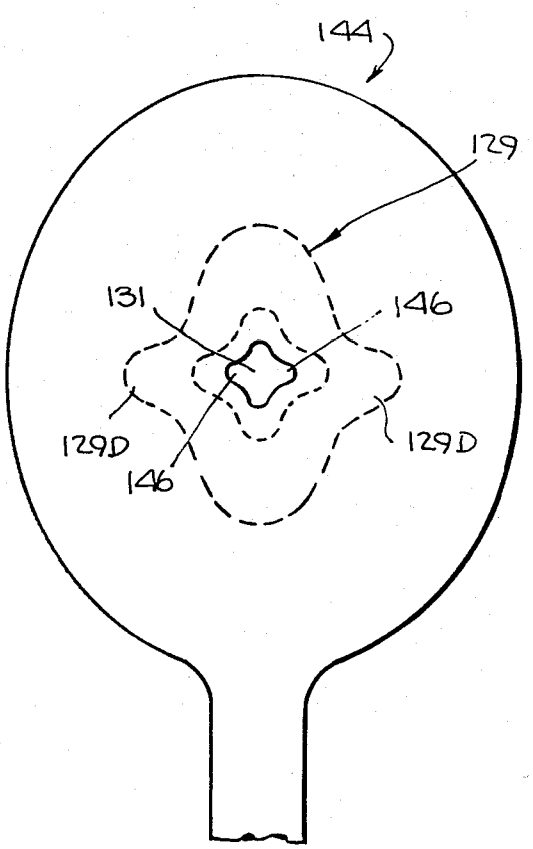
FIG. 10C is a front schematic view of a wide width spoke tip.
Figure 10B:
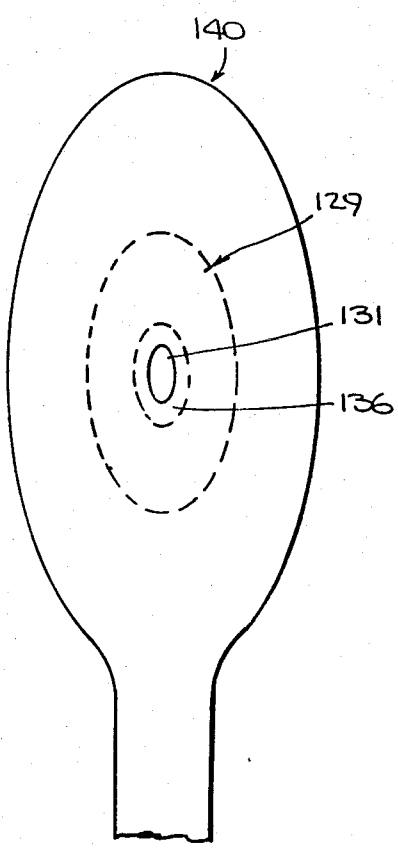
FIG. 10B is a front schematic view of an average width spoke tip.
Figure 10A:
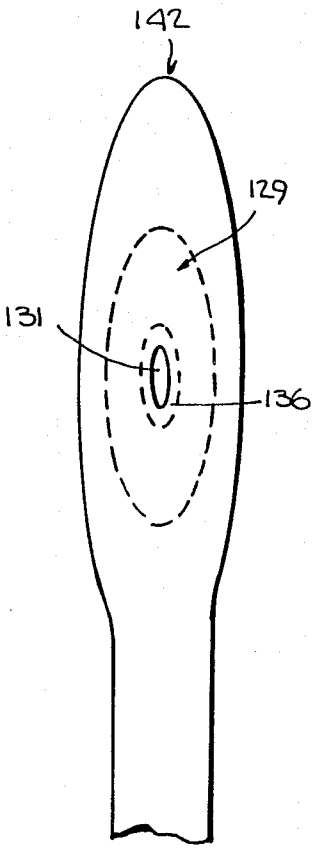
FIG. 10A is a front schematic view of a narrow width spoke tip.

FIGS. 10A, 10B and 10C schematically show spoke tips of varying width so as to enable character elements of different widths to be cast onto or otherwise secured to the spoke tip. If all characters in the print wheel are to have the same width, and a given number of characters are to be printed per inch, for example, 10, 12 or 15 per inch, then all spoke elements for the print wheel will have the same spoke tip width, and a spoke tip 140 of about 0.060–0.070 inch in width, for example, can be provided as shown in FIG. 10B. If however, proportional width print resembling set type is to be printed, the print wheel must be provided with characters of varying width, and the width of the spoke tips will vary in accordance with the character carried by a particular spoke bar. For proportional spacing, a number of spoke tip widths, for example seven, can be provided. If the character widths are expressed in units, with a maximum character width being 8 units, for example, then a narrow character width can represent two units and be cast on to a narrower spoke tip 142 having a width of about, 0.030–0.035 inch for example, as shown in FIG. 10A. An average character width can represent 4 units and can be cast on to the spoke tip 140 (FIG. 10B), which is then an average width spoke tip. A maximum 8 unit width character can correspondingly be cast on to a widened spoke tip 144 having a width of about 0.110–0.115 inch, for example, as shown in FIG. 10C. The narrow width spoke tip 142 and the average width spoke tip 140 can be configured as shown in FIGS. 7–9 and formed as described above. The wide spoke tip depicted in FIG. 10C, however, can include a pair of eyelet gussett openings 146 which laterally expand the locking eyelet 131 so as to better distribute the material portion 136B and the hammer impact energy across the wider character. In the widened spoke tip 144, the concavity 129 is also laterally expanded at 129D, as shown by the broken lines in FIG. 10C, but the vertical extent of the raised mound remains the same as in the other width spoke tips so that the hammer nose piece engages all tips in substantially the same manner.

The character elements can be cast onto the spoke tips in an automated process. A subsequent manual operation may be utilized to affix a special character element to an otherwise standard print wheel.

The spoke tips described above directly receive the hammer nose or other alignment element carried by the hammer to transmit the force of the hammer directly to the spoke tip without any intervening rear strike pad. The spoke tips described above also enable a minimum amount of plastic or other bonding material to be used in attaching the character element to the tip while at the same time providing a secure attachment of the character element to the tip.

Referring now to FIGS. 11–13, a modular press forming die comprising a die frame 150 (FIG. 11) and individual dies (FIGS. 12–13) for shaping metal spoke tips of varying width is depicted. With the die frame 150 depicted in FIG. 11, according to an aspect of the invention, metal spoke tips of varying width can be formed without the need for cutting a complete pressing die for each new print wheel character sequence. The die frame 150 includes a depressed ring groove 152 which will accept any width die insert, i.e. a standard width insert, a die half of which is as depicted in FIG. 12 and designated 154, or proportional width die inserts, die halves of which are shown in FIG. 13 and designated 155, 154 and 156. Each die insert half includes a radial opening or hole 158 in each edge 160, 161, preferably along the central axis 162 of the insert half, which is used to secure the insert half in the ring groove 152. Concentrically disposed adjacent the inner and outer peripheries of the ring groove are inner 164 and outer 165 ring frames having pairs of radially aligned inner 167 and outer 168 openings through the respective ring frames. Each of the die insert halves 154–156 has its edge openings 158 disposed so as to be registerable with respective inner 167 and outer 168 openings of the inner and outer die frames. Thus, sized respective retainer pins 170 can be inserted through the respective inner and outer openings and received in the edge openings of the die insert halves to retain the die insert halves in the die frame. A pair of the insert retainer pins captures each die insert half in the circular groove. The aligned inner and outer openings can be provided along radii spaced, for example, 3.6° apart to provide a 100 spoke print wheel. Such a die frame can then accept, if desired, 100 of the standard width die insert halves or a combination of proportional spaced insert halves. A wider, proportionally spaced die half will usually be placed adjacent a narrower die half as shown at the left of FIG. 11 in order to efficiently utilize the circumferential extent of a print wheel. For standard or narrow spacing, for example 15 per inch "microtype", equal width die insert halves 154 will be separated by equal spaces, as shown at the right of FIG. 11. Providing the insert retainer pins with scaffold nail end shapes as shown, enables the pins to be readily removed. The die insert halves can be stored for use in other print wheel fabrications, thereby effecting a significant reduction in die component storage space. Thus, almost all print wheels having a desired character set can be formed without the need to cut and fit individual die halves.

FIG. 11 depicts the base or bottom frame section of the modular press forming die, and a top frame section similar to the base frame section shown in FIG. 11 is provided. The base and top portions mate to form the modular press forming die. The assembled press forming die accepts spoke tips in the form of flat metal stock and forms and shapes the metal in accordance with the inserts provided in the die frame. The spoke bars and spoke ring are formed in other operations, usually before the tips are formed.

While numerically cut dies, each made for a particular character set, are potentially stronger, if the character sequence being formed is a less frequently used set, it can be economical to assemble the modular die frame and inserts of FIGS. 11–13, which do not require cutting individual width die blanks. This modular die system also allows a rapid response to short lead time requests for new print wheel character sequences.

Certain changes and modifications to the embodiments of the invention disclosed herein will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. A rotary print element comprising:

a hub;

a plurality of metal bar elements extending from and surrounding said hub wherein each bar element has a length extending from one end adjacent said hub through a second end region remote from said hub, with each metal bar element having a front surface and a rear surface and with each metal bar element having a substantially uniform thickness along the length thereof;

said second remote end region of each metal bar element having at least one concave shaped portion defining a cavity for receiving a printer impact hammer, said at least one concave shaped portion having an inner surface and an outer surface, said inner surface of said at least one concave shaped portion being part of said metal bar element rear surface and said outer surface of said at least one concave shaped portion being part of said metal bar element front surface;

a plastic element bonded to the front surface of the second remote and region of each metal bar element having said substantially uniform thickness, said bonded plastic element and said second remote end region of each metal bar element defining a print tip with the rear surface of the second remote end region of each metal bar element defining said inner surface of said at least one concave shaped portion having a significant surface area thereof without plastic bonded thereto.

2. The rotary print element of claim 1 wherein said plurality of metal bar elements are all integrally formed from a single sheet of metal.

3. The rotary print element of claim 2 wherein the shaped rear surface of the second remote end region of each bar element defines a concavity.

4. The rotary print element of claim 1 wherein said hub and said plurality of metal bar elements are all integrally formed from a single sheet of metal.

5. The rotary print element of claim 1 wherein said second remote ed region of each metal bar element having said plastic element bonded to the front surface thereof and defining said print tip has the opposite rear surface of said metal bar shaped to receive the print impact hammer.

6. A hub for a rotary print element comprising:

a base portion generally extending in a plane;

a peripheral portion joined to and surrounding said base portion and extending from said base portion; at an angle with respect to the plane of said base portion;

said base portion having at least one annular groove therein or engaging an alignment pin, with said groove having a hole therethrough for receiving said engaged alignment pin.

7. The hub of claim 6 wherein said peripheral portion has shaped surfaces formed thereon.

8. The hub of claim 7 wherein said shaped surfaces are distributed uniformly around said peripheral portion.

9. The hub of claim 8 wherein said peripheral portion extends at an angle of from about 90? to about 165? with respect to the plane of said base portion.

10. The hub of claim 9 wherein said base portion has more than one annular groove therein, each for engaging an alignment pin, with each said groove having a hole therethrough.

11. The hub of claim 8 wherein said base portion and said peripheral portion are both integrally formed from a single sheet of metal.

12. A rotary print element comprising:

a hub having a base portion generally extending in a plane and a peripheral portion surrounding said base portion and extending at an angle with respect to the plane of said base portion whereby said peripheral portion and said base portion of said hub extend in different planes;

a plurality of bar-like elements extending radially from said peripheral portion and distributed uniformly around said peripheral portion;

wherein said hub, said peripheral portion, and aid plurality of bar-like elements are all integrally formed from a single sheet of metal.

13. The rotary print element of claim 12 wherein said base portion has at least one annular groove therein for engaging an alignment pin with said groove having a hole therethrough for receiving said engaged alignment pin.

14. The rotary print element of claim 13 wherein said peripheral portion has shaped surfaces formed thereon.

15. The rotary print element of claim 14 wherein said shaped surfaces are distributed uniformly around said peripheral portion.

16. The rotary print element of claim 15 wherein said peripheral portion extends at an angle of from about 90° to about 165° with respect to the plane of said base portion.

17. The rotary print element of claim 16 wherein said base portion has more than one annular groove therein, each groove for engaging an alignment pin, with each said groove having a hole therethrough.

* * * * *